US007690357B2

(12) United States Patent
Fujimoto et al.

(10) Patent No.: US 7,690,357 B2
(45) Date of Patent: Apr. 6, 2010

(54) FUEL INJECTION VALVE

(75) Inventors: Hiroyuki Fujimoto, Obu (JP); Hiroshi Kawazoe, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 0 days.

(21) Appl. No.: 12/164,385

(22) Filed: Jun. 30, 2008

(65) Prior Publication Data

US 2009/0007887 A1 Jan. 8, 2009

(30) Foreign Application Priority Data

Jul. 6, 2007 (JP) ..... 2007-178048

(51) Int. Cl.
*F02M 59/46* (2006.01)

(52) U.S. Cl. ..... 123/467; 239/585.1

(58) Field of Classification Search ..... 123/467, 123/476; 239/533.12, 585.1
See application file for complete search history.

(56) References Cited

U.S. PATENT DOCUMENTS

| | | | | |
|---|---|---|---|---|
| 4,801,095 | A * | 1/1989 | Banzhaf et al. | 239/533.3 |
| 5,012,982 | A | 5/1991 | Souma et al. | |
| 5,351,398 | A * | 10/1994 | Haxell | 29/890.142 |
| 6,168,095 | B1 * | 1/2001 | Seitter et al. | 239/533.3 |
| 6,427,667 | B1 * | 8/2002 | Kato | 123/470 |
| 6,508,416 | B1 * | 1/2003 | Mastro et al. | 239/585.1 |
| 6,543,424 | B1 | 4/2003 | Yamaguchi et al. | |
| 6,851,630 | B2 * | 2/2005 | Nagaoka et al. | 239/585.1 |
| 7,419,553 | B2 * | 9/2008 | Liedtke et al. | 148/319 |
| 7,444,991 | B2 * | 11/2008 | Joseph | 123/467 |
| 7,506,826 | B2 * | 3/2009 | Miller | 239/585.1 |
| 7,563,346 | B2 * | 7/2009 | Chen | 204/192.15 |
| 2007/0215117 | A1 * | 9/2007 | Matsuo et al. | 123/476 |
| 2007/0251505 | A1 * | 11/2007 | Matsuo et al. | 123/476 |
| 2009/0007886 | A1 * | 1/2009 | Akabane et al. | 123/476 |

FOREIGN PATENT DOCUMENTS

| | | |
|---|---|---|
| JP | 63125875 | 5/1988 |
| JP | 63295855 | 12/1988 |
| JP | 2001055963 | 2/2001 |
| JP | 2003206820 | 7/2003 |
| JP | 2003328894 | 11/2003 |
| JP | 2004293312 | 10/2004 |

* cited by examiner

*Primary Examiner*—Hai H Huynh
(74) *Attorney, Agent, or Firm*—Dennison, Schultz & MacDonald

(57) ABSTRACT

A fuel injection valve is provided with a main body and a valve member. The main body has a fuel passage and a fuel injection opening formed at the downstream-end of the fuel passage. The valve member is provided in the fuel passage. The valve member is configured to move between a first position in which the valve member closes the fuel injection opening and a second position in which the valve member opens the fuel injection opening. A hardened layer is formed on abutment surfaces of the valve member and the main body that abut with each other. The hardness of this hardened layer is lower in its surface side than in its bottom side. According to this structure, the stress generated inside the hardened layer is suppressed, and breakage and detachment of the hardened layer are prevented.

7 Claims, 6 Drawing Sheets

FUEL INJECTION VALVE

CROSS-REFERENCE TO RELATED APPLICATION

This application claims priority to Japanese Patent Application No. 2007-178048, filed on Jul. 6, 2007, the contents of which are hereby incorporated by reference into the present specification.

BACKGROUND OF THE INVENTION

1. Field of the Invention

The present invention relates to a fuel injection valve, particularly to a fuel injection valve which injects fuel into an internal combustion engine.

2. Description of the Related Art

Japanese Patent Application Publication No. S63-125875 discloses a fuel injection valve that injects fuel into an internal combustion engine. This fuel injection valve is provided with a main body and a valve member disposed in the main body. The main body comprises a fuel passage and a fuel injection opening formed at the downstream-end of the fuel passage. The valve member is configured to move between a first position in which the valve member closes the fuel injection opening and a second position in which the valve member opens the fuel injection opening. The valve member is biased toward the first position by a coil spring.

The main body of the fuel injection valve is provided with a core disposed on the upstream side of the valve member, and an electromagnetic coil which magnetizes the core. The electricity is turned on and provided to the electromagnetic coil at the timing when the fuel is to be injected. When the electricity is provided to the electromagnetic coil, the core and the valve member are magnetized. Simultaneously, the valve member is attracted to the core and moves to the second position. Thereby, the fuel injection opening is opened and the fuel is injected from the fuel injection opening.

When the electricity is provided to the electromagnetic coil and the valve member moves to the second position, the valve member and the core strongly collide with each other. Thereby, in this conventional fuel injection valve, a hardened layer with higher hardness is formed on abutment surfaces of the valve member and the core that are to abut with each other. Thereby, deformation and damage of the valve member and the core are prevented.

The conventional hardened layer mentioned above has a shock absorbing layer formed on its base member (the valve member or the core) and a surface hardening layer formed on the shock absorbing layer. The hardness of the surface hardening layer is adjusted to be higher than the hardness of the shock absorbing layer. That is, the hardness of the hardened layer is high on its surface side and low on its bottom side. According to this construction, it allegedly is possible to absorb shock exerted on the hardened layer and to prevent breakage and detachment of the hardened layer.

BRIEF SUMMARY OF THE INVENTION

In the conventional hardened layer mentioned above, the shock absorbing layer which is relatively low in hardness is formed below the surface hardening layer which is relatively high in hardness. Thereby, when the force is applied to the surface of the hardened layer, a very high stress is easily generated in the surface of the hardening layer that may result in undesirable conditions such as the breakage, detachment, and the like. By the structure of the conventional hardened layer, it is not possible to sufficiently prevent the breakage and the detachment of the hardened layer.

The present invention solves the problem mentioned above. The present invention provides a technique of forming a hardened layer having high durability on abutting surfaces of a valve member and a main body that are to abut with each other.

A fuel injection valve realized by the present teachings is provided with a main body and a valve member. The main body comprises a fuel passage and a fuel injection opening formed at the downstream-end of the fuel passage. The valve member is disposed in the fuel passage. The valve member is configured to move between a first position in which the valve member closes the fuel injection opening and a second position in which the valve member opens the fuel injection opening. The main body and the valve member each comprise an abutment surface that is configured to abut with each other. A hardened layer is formed on at least one of the abutment surfaces of the valve member and the main body. The hardness of the hardened layer is lower in its surface side than in its bottom side.

In this fuel injection valve, at least one of the abutment surfaces of the valve member and the main body for abutting with each other is covered with the hardened layer whose hardness is higher than the hardness of the valve member and the main body. Thereby, deformation and damage of the valve member and the main body can be prevented. Further, the hardness of the hardened layer is low in its surface side and high in its bottom or inner side. According to this construction, it is possible to relieve and endure the residual stress of the hardened layer. That is, when a force is applied on the hardened layer from the surface side, the stress generated inside the hardened layer is buffered in its surface side. Thereby, even in a case where the valve member and the main body collides with each other while entrapping a foreign substance in between the abutment surfaces, exertion of a local and strengthened force onto a very hard surface that encounters the foreign substance (such collision tends to give rise to cracking of the hardened layer) may be avoided. The breakage and the detachment of the hardened layer are prevented by the structural characteristic of the hardened layer.

In this fuel injection valve, since at least one of the abutment surfaces of the valve member and the main body is covered with the hardened layer that holds high durability, it is possible to maintain the functions of the fuel injection valve for a longer period of time.

The hardened layer mentioned above preferably includes a high-hardened layer which is formed in its bottom side, and a low-hardened layer which is formed in its surface side. In the aforementioned hardened layer, the layer may be configured such that the hardness of the low-hardened layer is lower than the hardness of the high-hardened layer.

In this fuel injection valve, the valve member and the main body may be protected by the high-hardened layer, and the stress generated inside the hardened layer may be suppressed by the low-hardened layer. By adjusting the hardness and the thickness of the high-hardened layer and the low-hardened layer to be high and low respectively, or in combination, it may be possible to realize the hardened layer having the desired tolerance functions.

The hardened layer mentioned above preferably includes only the high-hardened layer and the low-hardened layer.

The hardened layer may have one low-hardened layer or a plurality of low-hardened layers. Likewise, the hardened layer may have one or a plurality of high-hardened layer(s). Such configuration may be determined in accordance with the desired thickness and/or the hardness of the hardened layer.

However, in a case where the required hardness, thickness, and function of the high-hardened layer and the low-hardened layer can be realized by materializing one high-hardened layer and one low-hardened layer, such configuration is preferable for it is easier to form the hardened layer in such configuration. It is possible to prevent employment of a complicated structure which may give rise to difficulty in the manufacturing of the fuel injection valve.

Alternatively, in the fuel injection valve mentioned above, the hardness of the hardened layer is preferably continuously increased from its surface side to its bottom side.

By setting the distribution of the hardness of the hardened layer with small indents and successively changing the hardness of the hardened layer in its depthwise direction, it is possible to more precisely realize the hardened layer having the desired functions.

In the fuel injection valve according to the present invention, the hardened layer is preferably made of Diamond-like Carbon.

Generally, Diamond-like Carbon is known to be excellent in hardness and abrasion resistance. However, Diamond-like Carbon used in hardened layer easily yields to breakage and detachment. According to the art of the present invention, it is possible to realize the hardened layer using Diamond-like Carbon with high durability.

DETAILED DESCRIPTION OF THE INVENTION

Some of the characteristic features of the embodiments in which the present invention may be carried out are listed below.

(Feature 1) A main body may be provided with a body, a core fixed in the body, and a valve seat fixed at one end of the body. The valve seat may be provided with a fuel injection opening. A valve member which is disposed in the main body may be formed between the core and the valve seat. The valve member may be constructed so as to move between a first position in which one end of the valve member abuts with the valve seat to close the fuel injection opening and a second position in which one end of the valve member is brought apart from the valve seat and the other end abuts with the core.

(Feature 2) A plug portion which abuts with the valve seat so as to close the fuel injection opening may be provided in one end of the valve member.

(Feature 3) The core and the valve member may be made of magnetic material. When the electricity is turned on to an electromagnetic coil, the core and the valve member are magnetized so that the valve member is attracted to the core.

Embodiment of the Invention

Figure 1:
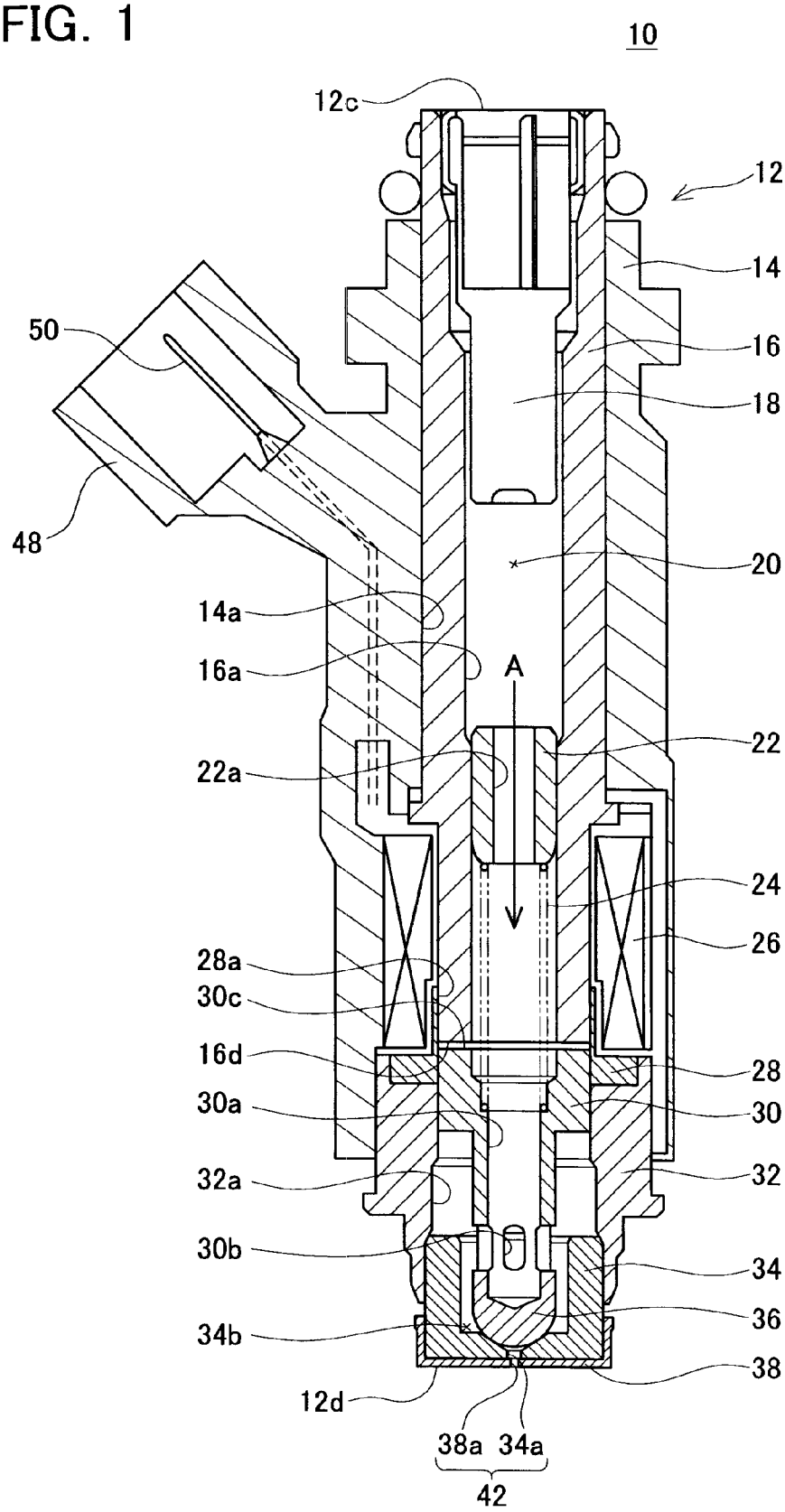
FIG. 1 is a vertical sectional view of a fuel injection valve.

An unlimiting embodiment of a fuel injection valve actualized with the present teachings will be described with reference to the figures. FIG. 1 shows a vertical sectional view of a fuel injection valve 10 of the embodiment. As shown in FIG. 1, the fuel injection valve 10 is provided with a main body 12, a valve member 30, a coil spring 24 and an electromagnetic coil 26.

Inside the main body 12, a fuel passage 20 through which the fuel passes is formed. An arrow A in FIG. 1 shows the flowing direction of the fuel. At the downstream-end 12*d* of the main body 12, a fuel injection opening 42 is formed. Further upstream to the upstream-end 12*c* of the main body 12, a fuel pipe (not shown) which extends from a fuel tank (not shown) is connected. The fuel passage 20 communicates the fuel injection opening 42 and the upstream-end 12*c* of the main body 12.

In the present specification, the expression "upstream" means "upstream with regard to the fuel flowing direction A", and the expression "downstream" means "downstream with regard to the fuel flowing direction A". That is, the expressions "upstream side" and "downstream side" correspond to the "upper side" and the "lower side" as shown in FIG. 1 respectively.

A configuration of the main body 12 will be described in detail. As shown in FIG. 1, the main body 12 is provided with a body 14, a core 16, an spring pin 22, a valve seat holder 32 and a valve seat 34.

The body 14 is a cylindrical member which constructs an outer frame of the main body 12. The body 14 is made of resin. On an exterior surface of the body 14, a connector 48 which is connected to an external control unit (not shown) is formed. In the connector 48, a plurality of terminal pins 50 which are electrically connected to the electromagnetic coil 26 is provided.

The core 16 is a cylindrical member which is made of magnetic material and is fixed to a through hole 14*a* of the body 14. A part of the core 16 protrudes from the through hole 14*a* of the body 14 to the upstream side. That is, a part of the core 16 rises out in the upstream direction from the uppermost edge of the body 14. The downstream-end 16*d* of the core 16 is arranged within the through hole 14*a* of the body 14 at the downstream side. A through hole 16*a* formed inside the core 16 constructs a part of the fuel passage 20. In the through hole 16*a* of the core 16, a filter 18 for removing foreign substances from the fuel is provided.

The spring pin 22 is a hollow cylindrical member and is pressedly inserted into the through hole 16*a* of the core 16. The spring pin 22 is formed on the upstream side of the coil spring 24 and abuts with the upstream-end of the coil spring 24. The spring pin 22 determines the amount to which the coil spring 24 is to be compressed by the adjustment of its inserted position. A through hole 22*a* of the spring pin 22 constructs a part of the fuel passage 20.

The valve seat holder 32 is a cylindrical member with a through hole 32*a* formed in the midst thereof. The valve seat holder 32 is fixed into the through hole 14*a* of the body 14. The valve seat holder 32 is formed on the downstream side of the core 16, and a part of the valve seat holder 32 protrudes from the through hole 14*a* of the body 14 towards the downstream side. Inside the through hole 32*a* of the valve seat holder 32, the valve member 30 is disposed. A clearance is formed between the interior surface of the through hole 32*a* of the valve seat holder 32 and exterior surface of the valve member 30. The clearance formed thereof constructs a part of the fuel passage 20. At the upstream-end of the valve seat holder 32, a cylindrical sleeve 28 made of non-magnetic material is provided. A through hole 28*a* is formed in along the center of the cylindrical sleeve 28. In the through hole 28*a* of the sleeve 28, the downstream-end 16*d* of the core 16 and the upstream-end 30*c* of the valve member 30 are inserted. The valve member 30 is slidably arranged with respect to the interior side surface of the through hole 28*a* of the sleeve 28.

The valve seat 34 is a cylindrical member and is fixed into the through hole 32*a* of the valve seat holder 32. A cavity is formed inside the valve seat 34 with a bottom surface residing on the downstream side. A through hole 34*a* is formed on the bottom surface of the valve seat 34. The downstream part of the valve member 30 is arranged inside the internal cavity 34*b* of the valve seat 34. The internal cavity 34*b* of the valve seat 34 constructs a part of the fuel passage 20. Over a part of an exterior surface of the valve seat 34 at the downstream side, an orifice plate 38 is provided. A through hole 38*a* is formed on the orifice plate 38 at a location that corresponds to the position at which the through hole 34*a* is formed on the valve seat 34. The valve seat 34 and the orifice plate 38 are formed at the downstream-end 12*d* of the main body 12. Of the valve seat 34 and the orifice plate 38, through holes 34*a* and 38*a* construct the fuel injection opening 42.

Next, a construction of the valve member 30 will be described more in detail. The valve member 30 is a cylindrical member and is mainly made of magnetic material. The valve member 30 is hollowly formed, with a bottom surface residing on the downstream side; a through hole 30*a* is formed within the valve member 30. The valve member 30 is disposed in the through hole 32*a* of the valve seat holder 32, and is slidably supported so as to slide in the direction parallel to the fuel flowing direction A. The upstream-end 30*c* of the valve member 30 faces the downstream-end 16*d* of the core 16 which serves as a part of the main body 12. A plug portion 36 for closing the fuel injection opening 42 is provided at the downstream-end of the valve member 30. The internal hole 30*a* of the valve member 30 is communicated with the through hole 16*a* of the core 16 and constructs a part of the fuel passage 20. On the lower side surface of the valve member 30, a plurality of through holes 30*b* is formed. The plurality of through holes 30*b* align orthogonal to the fuel flowing direction between the internal through hole 30*a* and the plug portion 36. The internal through hole 30*a* of the valve member 30 is communicated with the internal cavity 34*b* of the valve seat 34 through the aforementioned through holes 30*b*.

Figure 2:
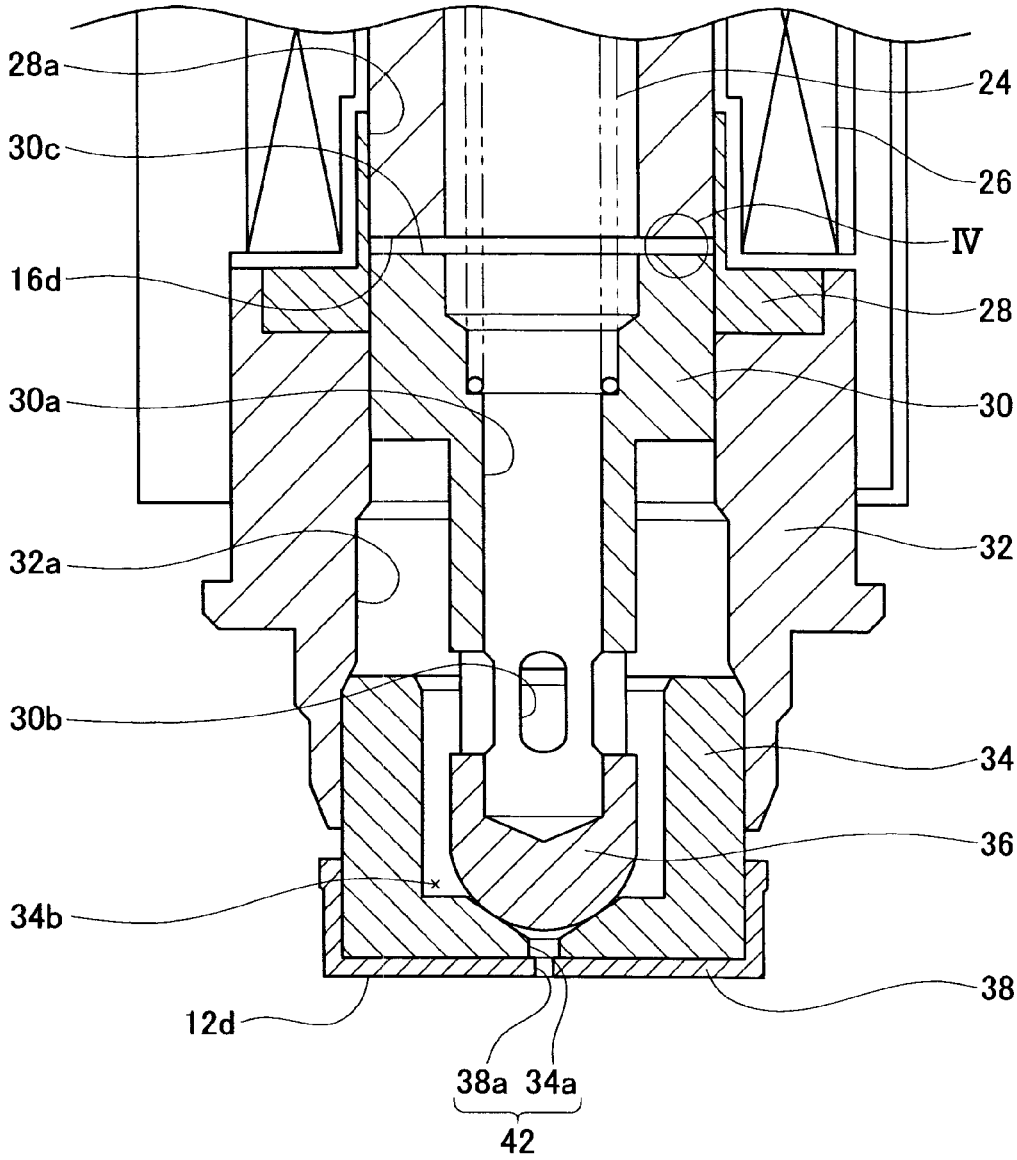
FIG. 2 shows a state in which a valve member is at a first position.
Figure 3:
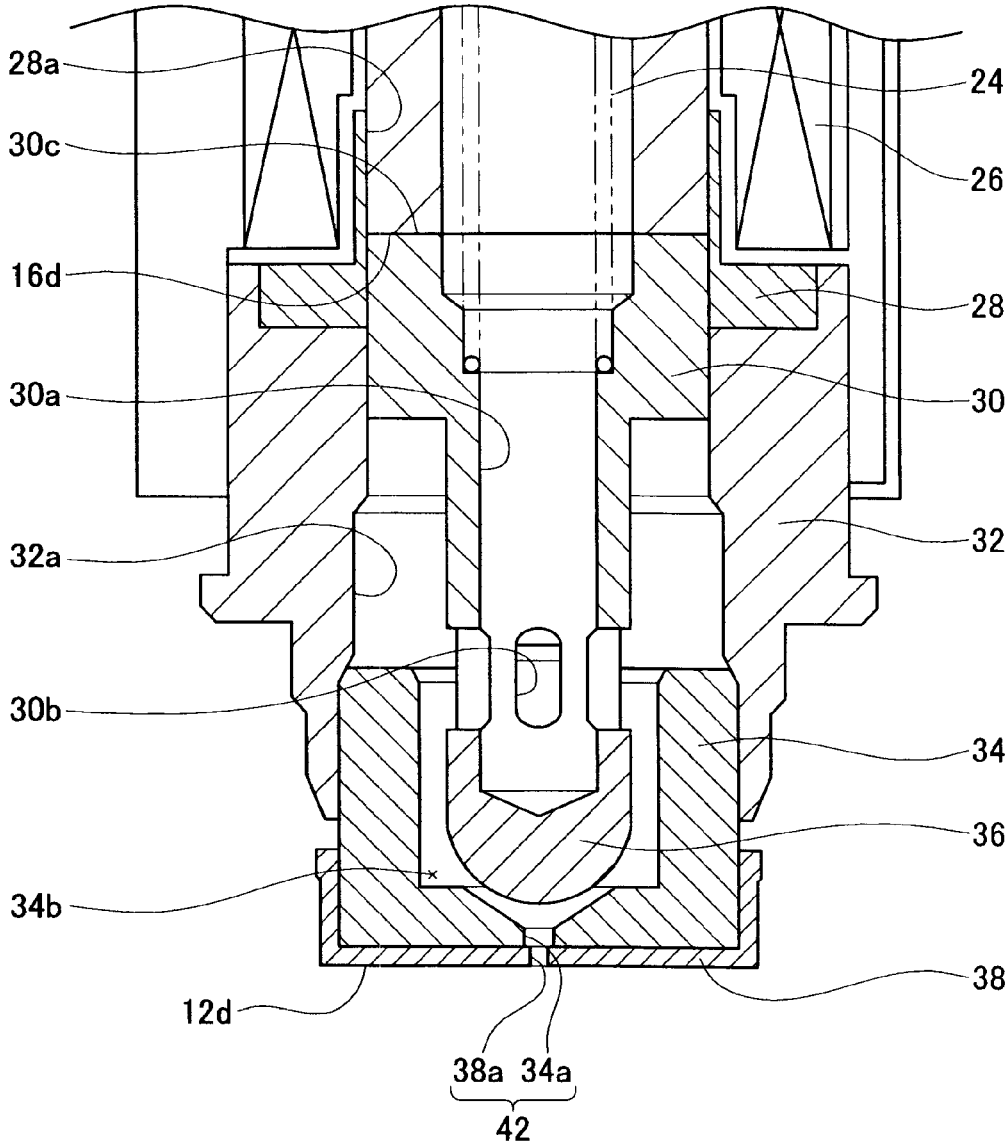
FIG. 3 shows a state in which the valve member is at a second position.

The valve member 30 is configured to move between a first position in which the valve member 30 closes the fuel injection opening 42 as shown in FIG. 2, and a second position in which the valve member 30 opens the fuel injection opening 42 as shown in FIG. 3. It should be noted that the first position is the limit to which the valve member 30 is able to move towards the downstream side, or the side towards the fuel injection opening 42, and the second position is the limit to which the valve member 30 is able to move towards the upstream side, receding from the side of the fuel injection opening 42. In the case where the valve member 30 is at the first position as shown in FIG. 2, the plug portion 36 serving as the downstream-end of the valve member 30 abuts with the valve seat 34 so as to close the fuel injection opening 42. At this moment, the upstream-end 30*c* of the valve member 30 is separated from the downstream-end 16*d* of the core 16. Meanwhile, in the case where the valve member 30 is at the second position as shown in FIG. 3, the plug portion 36 serving as the downstream-end of the valve member 30 is brought apart from the valve seat 34 so as to open the fuel injection opening 42. At this moment, the upstream-end 30*c* of the valve member 30 abuts with the downstream-end 16*d* of the core 16.

Figure 4:
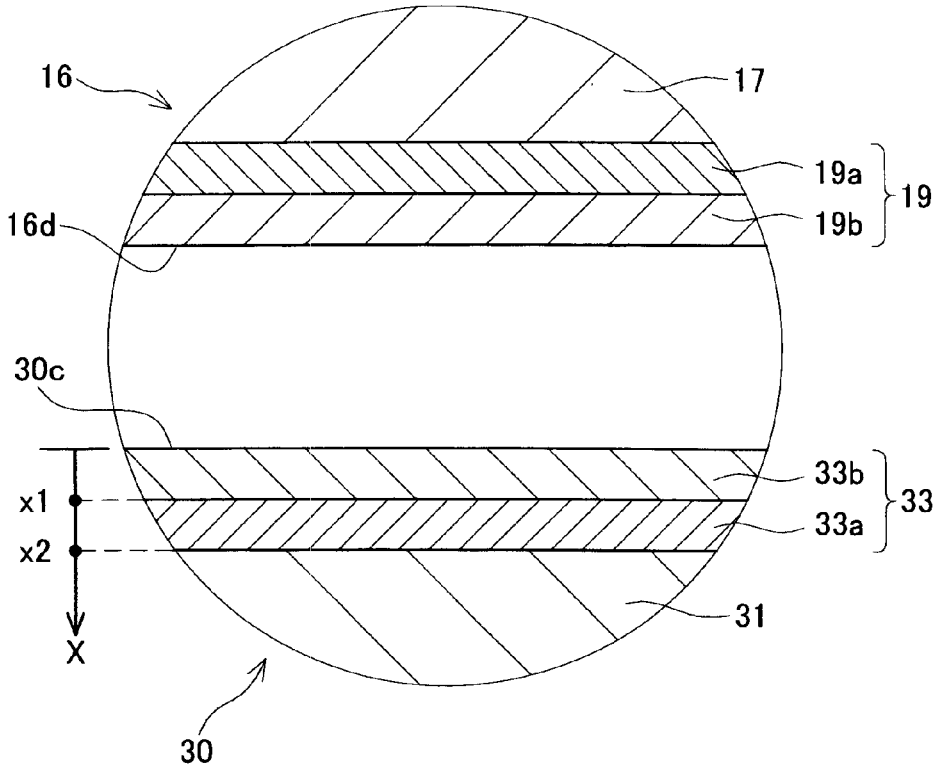
FIG. 4 is an enlarged view of section IV in FIG. 2.

FIG. 4 is an enlarged view showing the IV section of FIG. 2. As shown in FIG. 4, the upstream-end 30*c* of the valve member 30 is covered with a hardened layer 33. The hardened layer 33 is made of material which has higher hardness than material of a body part 31 of the valve member 30. The hardened layer 33 in the present embodiment is made of Diamond-like Carbon (DLC). The body part 31 of the valve member 30 is made of magnetic stainless steel. Furthermore, the hardened layer 33 includes a high-hardened layer 33*a* laminated on the body part 31 of the valve member 30 and a low-hardened layer 33*b* laminated on the high-hardened layer 33*a*. The hardness of the high-hardened layer 33*a* is configured so as to be higher than the hardness of the low-hardened layer 33*b*. In the present embodiment, the Vickers hardness of the high-hardened layer 33*a* is adjusted to be approximately 1500 and the Vickers hardness of the low-hardened layer 33*b* is adjusted to be approximately 1200, while the Vickers hardness of the body part 31 of the valve member 30 is approximately 200. In the valve member 30, the hardened layer 33 may also be formed over surfaces other than the surface of the upstream-end 30*c*. For instance, in the present embodiment, the hardened layer 33 further covers the side surface of the valve member 30 along the area which slides against the sleeve 28 and the valve seat holder 32. Note that the hardened layer may be configured of any materials that comprise higher hardness than the body part 31 of the valve member 30; it should be understood that the aforesaid material is not limited to DLC. Furthermore, the Vickers hardness of the high-hardened layer 33*a*, low-hardened layer 33*b* and body part 31 is not limited to the aforesaid numerical values. The specific numerical values are indicated to explain one of the technological concepts of the teachings disclosed herewith that the high-hardened layer 33*a* is configured to be harder than the low-hardened layer 33*b*, and the hardened layer 33 is configured to be harder than the body part 31 of the valve member.

Figure 5:
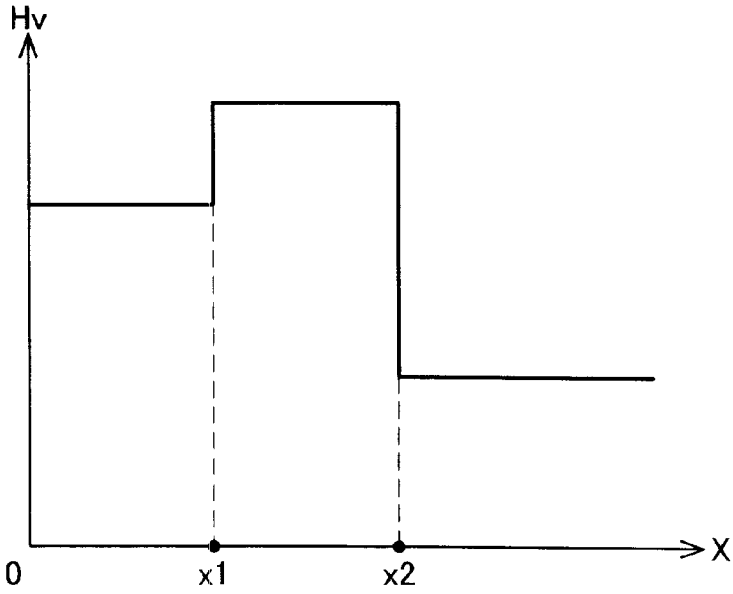
FIG. 5 shows the relationship in Vickers hardness and the thickness direction of a hardened layer.

FIG. 5 shows the relationship in Vickers hardness Hv with regard to the thickness direction of the hardened layer 33. The horizontal axis X of the graph shown in FIG. 5 corresponds to the X axis in FIG. 4. The axis X hence shows a distance (depth) from the surface of the upstream-end 30*c* towards the bottom surface of the hardened layer 33. Thus, the graph shows the degree of hardness (in the Vickers hardness) at the respective depth from the surface of the upstream-end 30*c*. The x-coordinate range of 0 to x2 corresponds to the hardened layer 33. The x-coordinate range of 0 to x1 corresponds to the low-hardened layer 33*b*, and the x-coordinate range of x1 to x2 corresponds to the high-hardened layer 33*a*. The x-coordinate range exceeding x2 corresponds to the body part 31. As shown in FIG. 5, the Vickers hardness Hv of the hardened layer 33 is low in the surface side, which is the side that is closer to the surface of the upstream end 30*c* (x=0). And, the Vickers hardness Hv of the hardened layer 33 is high in the bottom side, which is the side that is closer to the body part 31 of the valve member 30 (x=x2).

Similarly, the downstream-end 16*d* of the core 16 is covered with a hardened layer 19. The hardened layer 19 includes a high-hardened layer 19*a* laminated on a body part 17 of the core 16, and a low-hardened layer 19*b* laminated on the high-hardened layer 19*a*. The high-hardened layer 19*a*, low-hardened layer 19*b* and body part 17 of the core 16 may comprise the same or similar characteristic in their hardness as that of the high-hardened layer 33*a*, low-hardened layer 33*b* and the body part 31 of the valve member 30.

Next, the details of the configurations of the coil spring 24 and the electromagnetic coil 26 will be described. As aforementioned, the coil spring 24 is disposed in the through hole 16*a* of the core 16. The coil spring 24 is formed between the spring pin 22 and the valve member 30 in a state that the coil spring 24 is compressed. The upstream-end of the coil spring 24 abuts with the exterior bottom surface of the spring pin 22, and the downstream-end of the coil spring 24 abuts with a surface protruding within the through hole 30*a* of the valve member 30. The coil spring 24 biases the valve member 30 towards the first position, which is the movement limit in the downstream direction (refer to FIG. 2), by its elastic force.

The electromagnetic coil 26 is fixed in the through hole 14*a* of the body 14. The electromagnetic coil 26 surrounds a part of the core 16 including the downstream-end 16*d*. Electricity is turned on and provided to the electromagnetic coil 26 from the external control unit (not shown) through the terminal pins 50 of the connector 48. The electricity is provided at a timing at which the fuel is to be injected. The electromagnetic coil 26 generates a magnetic field by the electricity provided thereto.

Next, the manner in which the fuel injection valve 10 operates will be described. Fuel flows from the fuel pipe (not shown) which is connected to the upstream-end 12*c* into the main body 12 of the fuel injection valve 10. The flowing fuel flows through the fuel passage 20 and reaches the fuel injection opening 42 formed at the downstream-end 12*d* of the main body 12. In the case where the electricity is not provided to the electromagnetic coil 26, the valve member 30 is maintained at the first position by the bias force of the coil spring 24 (refer to FIG. 2). In this case, since the fuel injection opening 42 is closed by the plug portion 36 of the valve member 30, the fuel is not injected from the fuel injection opening 42.

Meanwhile, when the electricity is turned on and provided to the electromagnetic coil 26 and the electromagnetic coil 26 generates a magnetic field, thus magnetizing the core 16 and the valve member 30. in such condition, the core 16 and the valve member 30 attract each other such that the valve member 30 shifts its posture to the second position, moving upwards against the bias force of the coil spring 24 (refer to FIG. 3). The plug portion 36 of the valve member 30 is brought apart from the valve seat 34 such that the fuel injection opening 42 is opened. At this moment, the fuel is injected from the fuel injection opening 42. The electricity is intermittently provided to the coil spring 24 and the fuel is intermittently injected from the fuel injection opening 42.

When the electricity is provided to the electromagnetic coil 26 and the valve member 30 moves from the first position to the second position, the downstream-end 16*d* of the core 16 and the upstream-end 30*c* of the valve member 30 collide with each other with a relatively strong force. At this moment, relatively strong shock is exerted on the downstream-end 16*d* of the core 16 and the upstream-end 30*c* of the valve member 30. Particularly in a case where a foreign substance in the fuel is trapped in between the downstream-end 16*d* and the upstream-end 30*c*, there sometimes is a case in which the shock is locally reinforced. Occurrence of such local reinforcement of shock is undesirable, for it may cause damage and/or deformation of the surfaces of the core 16 and the valve member 30. To improve tolerance against such shock, the downstream-end 16*d* of the core 16 and the upstream-end 30*c* of the valve member 30 are covered with the hardened layers 19 and 33 respectively. Therefore, the deformation and the damage of the valve member 30 are effectively prevented.

In general, in the hardened layer made of Diamond-like Carbon, chromium nitride or the like, the residual stress tends to be high, and large stress is easily generated inside the hardened layer when force is put forth from exterior agent. Therefore, in a case of the shock being locally applied to the hardened layer, or a case of the shock being repeatedly applied to the hardened layer, there sometimes is a case where the hardened layer is broken or detached from the surface to which the layer had been adhering.

In order to remain impervious to such problem as mentioned above, in the hardened layers 19 and 33 of the present embodiment, the high-hardened layers 19*a* and 33*a* are formed on the bottom side (the inner side), and the low-hardened layers 19*b* and 33*b* are formed on the surface side (the outer side). Since the high-hardened layers 19*a* and 33*a* formed on the bottom side have sufficient hardness that may tolerate the force exerted thereupon, deformation and damage of the core 16 and valve member 30 are sufficiently prevented. Furthermore, breakage and damage of the hardened layers 19 and 33 themselves may also be prevented. Meanwhile, since the hardness of the low-hardened layers 19*b* and 33*b* formed on the surface side is configured to be relatively low, the stress generated in the hardened layers 19 and 33 is relieved. With the low-hardened layers 19*b* and 33*b* buffering the force applied to the hardened layers 19 and 33 and the high-hardened layers 19*a* and 33*a* enduring the same force, thereby even with Diamond-like Carbon which relatively easily yield to cracking, the breakage and the detachment of the hardened layers 19 and 33 are remarkably prevented. Since the hardened layers 19 and 33 are excellent in durability, the fuel injection valve 10 can maintain its functions for a longer period of time.

The specific embodiment of the present invention is described above, but these merely illustrate some possibilities of the invention and do not restrict the claims thereof. The art set forth in the claims includes various transformations and modifications to the specific embodiment set forth above.

Figure 6:
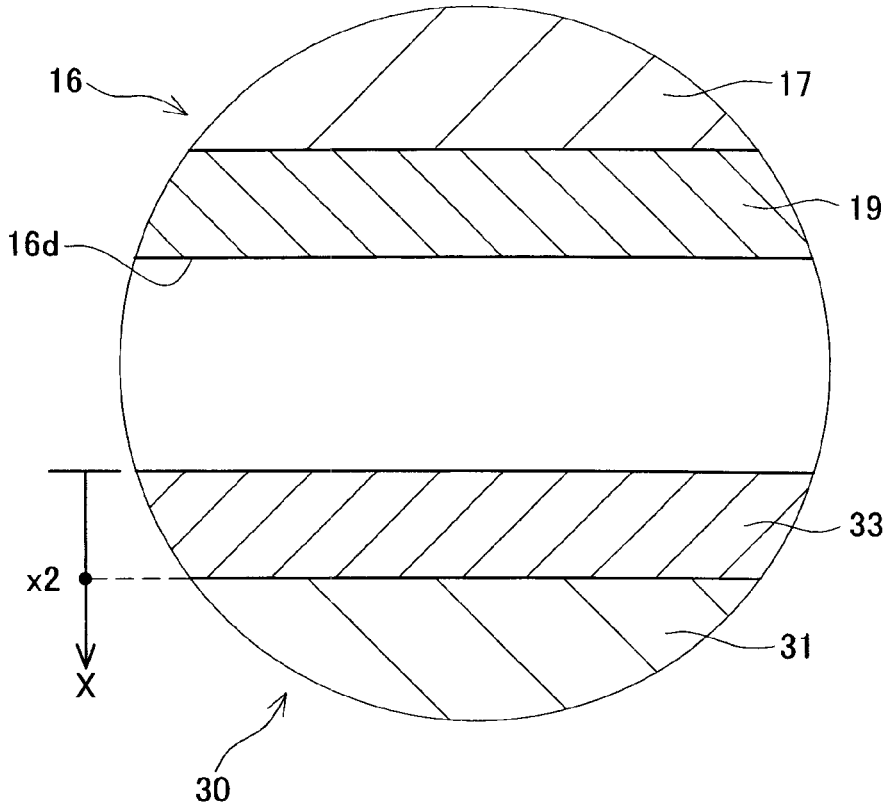
FIG. 6 shows a hardened layer configured as one layer.
Figure 7:
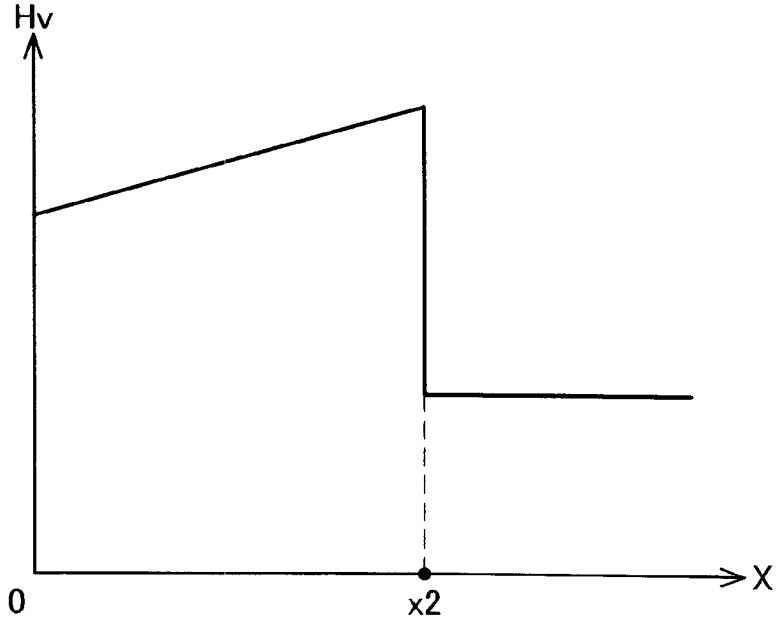
FIG. 7 shows the relationship in Vickers hardness and the thickness direction of the hardened layer configured as one layer.

For example in the embodiment mentioned above, the hardened layers 19 and 33 are constructed of two layers: of the high-hardened layers 19*a* and 33*a* and the low-hardened layers 19*b* and 33*b*. However, the hardened layers 19 and 33 may be constructed as one layer as shown in FIG. 6. In this case, as shown in FIG. 7, the hardness of the hardened layers 19 and 33 may each be configured to continuously rise (linearly increase in succession) from the surface 16*d* and 30*c* side (x=0) to the body parts 17 and 31 side (x=x2). It should be noted that a change in the hardness in accordance with the depth from the surface as shown in FIG. 7 is a mere example, and it should be understood that the distribution of the hardness thereof is not limited to the aforesaid manner. Change ratio or distribution rate of hardness in the thickness direction (x direction) may be configured to vary in one range from another (i.e. the hardness may increase in quadratic manner) in accordance with the position in the thickness direction (x-coordinate).

Figure 8:
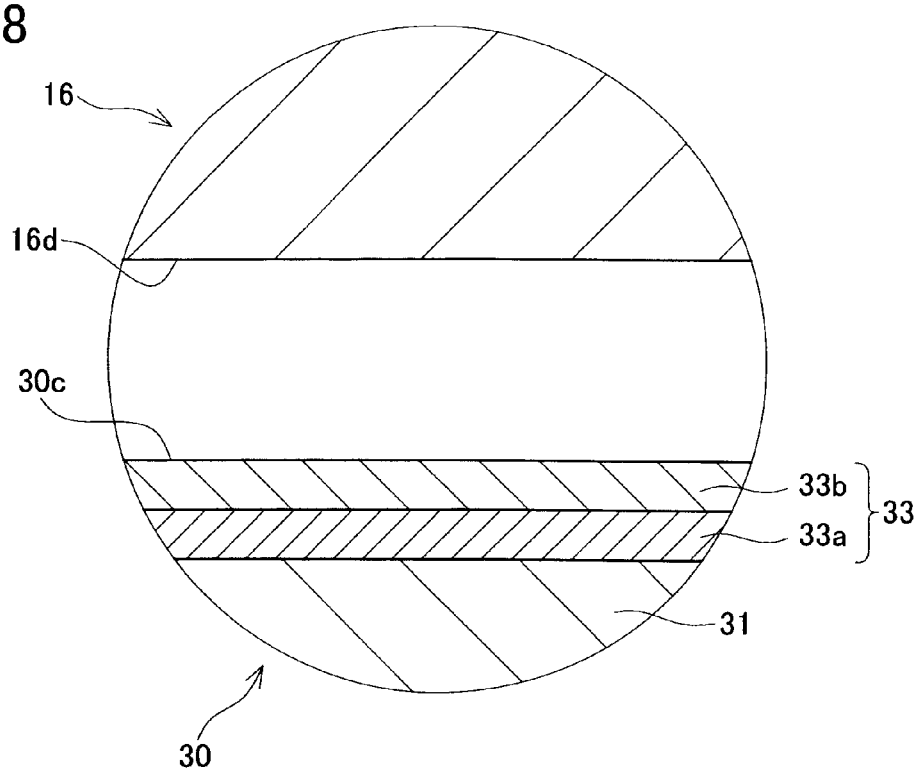
FIG. 8 shows an alternative example in which the hardened layer is formed only on the upstream-end of the valve member.
Figure 9:
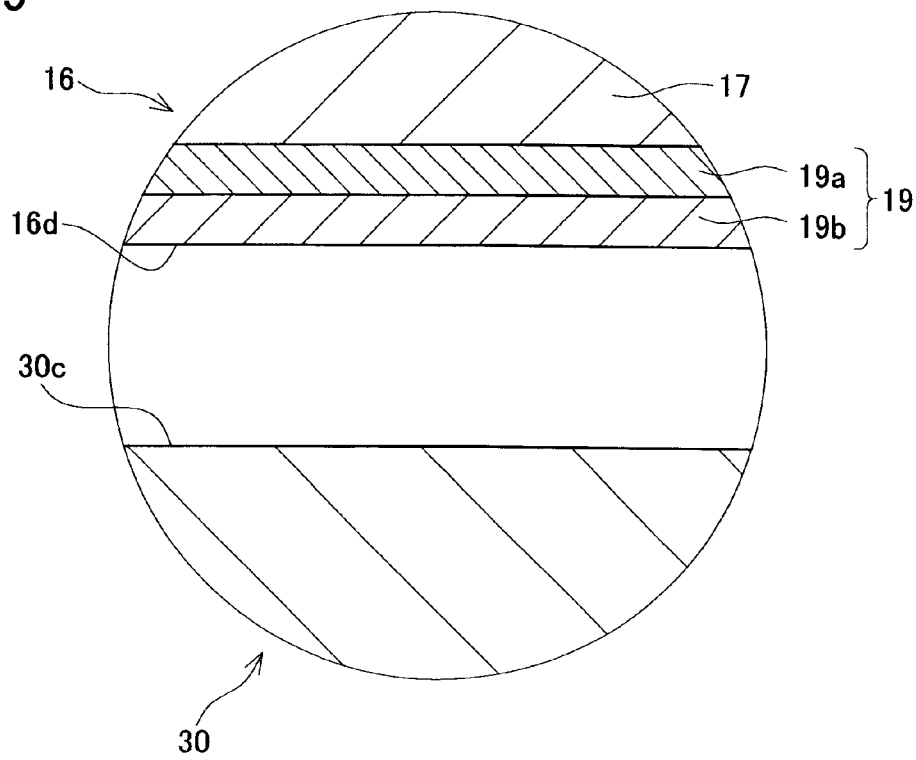
FIG. 9 shows another alternative example in which the hardened layer is formed only on the downstream-end of a core.

Furthermore, the hardened layers 19 and 33 described in the embodiment may be formed only at the upstream-end 30*c* of the valve member 30 as shown in FIG. 8, or may be formed only at the downstream-end 16*d* of the core 16 as shown in FIG. 9.

Furthermore, the technical elements disclosed in the present specification or figures may be utilized separately or in all types of conjunctions and are not limited to the conjunctions set forth in the claims at the time of filing of the application. Furthermore, the art disclosed in the present specification or figures may be utilized to simultaneously realize a plurality of aims or to realize one of these aims.

What is claimed is:

1. A fuel injection valve, comprising:

a main body that comprises a fuel passage and a fuel injection opening formed at the downstream-end of the fuel passage; and a valve member that is disposed in the fuel passage and is configured to move between a first position in which the valve member closes the fuel injection opening and a second position in which the valve member opens the fuel injection opening;

wherein the main body and the valve member each comprise an abutment surface that is configured to abut with each other, and a hardened layer formed of a single material is formed on at least one of the abutment surfaces of the main body and the valve member, wherein the hardness of the hardened layer is lower in a surface side than in a bottom side in contact with the at least one of the abutment surfaces.

2. A fuel injection valve as in claim 1, wherein the abutment surfaces of the main body and the valve member abut with each other in a case where the valve member moves to the second position.

3. A fuel injection valve as in claim 1, wherein the main body further comprises a core and an electromagnetic coil that magnetizes the core and the valve member, wherein the magnetized core attracts the valve member to the second position when electricity is provided to the electromagnetic coil; and the hardened layer is formed on at least one of the abutment surfaces of the core and the valve member that are configured to abut with each other.

4. A fuel injection valve as in claim 1, wherein the hardened layer comprises a high-hardened layer that is formed in its bottom side and a low-hardened layer that is formed in its surface side, wherein the low-hardened layer and the high-hardened layer are formed together of the single material, and the low-hardened layer is lower in hardness than the high-hardened layer.

5. A fuel injection valve as in claim 4, wherein the hardened layer comprises only the high-hardened layer and the low-hardened layer.

6. A fuel injection valve as in claim 1, wherein the hardness of the hardened layer is continuously increased from its surface side to its bottom side.

7. A fuel injection valve as in claim 1, wherein the hardened layer is made of Diamond-like Carbon.

* * * * *